US009834413B2

(12) United States Patent
Mittermayr

(10) Patent No.: US 9,834,413 B2
(45) Date of Patent: Dec. 5, 2017

(54) DOOR COUPLER WITH FLEXIBLY POSITIONABLE COUPLER ELEMENTS

(71) Applicant: Wittur Holding GmbH, Wiedenzhausen (DE)

(72) Inventor: Franz Mittermayr, Loich (AT)

(73) Assignee: Wittur Holding GmbH, Wiedenzhausen (DE)

( * ) Notice: Subject to any disclaimer, the term of this patent is extended or adjusted under 35 U.S.C. 154(b) by 0 days.

(21) Appl. No.: 14/711,488

(22) Filed: May 13, 2015

(65) Prior Publication Data

US 2015/0329326 A1 Nov. 19, 2015

(30) Foreign Application Priority Data

May 13, 2014 (DE) ..... 20 2014 102 232 U
May 28, 2014 (DE) ..... 20 2014 102 534 U

(51) Int. Cl.
*B66B 13/12* (2006.01)
*B66B 19/00* (2006.01)

(52) U.S. Cl.
CPC ..... *B66B 13/12* (2013.01); *B66B 19/007* (2013.01)

(58) Field of Classification Search
CPC ..... B66B 13/12; B66B 13/20; B66B 19/007
See application file for complete search history.

(56) References Cited

U.S. PATENT DOCUMENTS 5,819,877 A * 10/1998 Rivera ..... B66B 13/20 187/314
5,988,320 A * 11/1999 Mittermayr ..... B66B 13/12 187/319
6,189,658 B1 * 2/2001 Karner ..... B66B 13/12 187/309
6,446,759 B1 * 9/2002 Kulak ..... B66B 13/12 187/319
7,398,862 B2 * 7/2008 Dziwak ..... B66B 13/20 187/319
2007/0295564 A1 * 12/2007 Someya ..... B66B 13/20 187/319
2012/0118676 A1 * 5/2012 Utsunomiya ..... B66B 13/12 187/330

(Continued)

FOREIGN PATENT DOCUMENTS

CN 2885802 Y 4/2007
EP 2287104 A1 2/2011

(Continued)

*Primary Examiner* — Michael Riegelman

(57) ABSTRACT

A device for synchronously actuating and locking elevator doors, which are situated essentially one behind the other in the passage direction—such as a car door and a shaft door; the device includes entraining skids that are fastened to a first door by means of an entraining skid support and whose spacing relative to one another can be changed in order to be able to couple the first door to the second door and move the two doors together and the device is coupled to a linear drive unit that moves the doors in the opening and closing directions, characterized in that the entraining skid support has a plurality of first openings that make it possible to mount at least one, preferably both, of the entraining skids on the entraining skid support in different functional positions.

23 Claims, 14 Drawing Sheets

(56) References Cited

U.S. PATENT DOCUMENTS

| | | | | |
|---|---|---|---|---|
| 2012/0298453 | A1* | 11/2012 | Fujii | B66B 13/12 187/330 |
| 2012/0305336 | A1* | 12/2012 | Walker | B66B 13/12 187/330 |
| 2015/0203329 | A1* | 7/2015 | Zappa | B66B 13/125 187/319 |
| 2015/0329325 | A1* | 11/2015 | Mittermayr | B66B 13/20 187/330 |

FOREIGN PATENT DOCUMENTS

| | | | |
|---|---|---|---|
| ES | 1057054 | U | 6/2004 |
| WO | 2005077808 | A2 | 8/2005 |
| WO | 2012163940 | A1 | 12/2012 |

* cited by examiner

DOOR COUPLER WITH FLEXIBLY POSITIONABLE COUPLER ELEMENTS

FIELD OF THE INVENTION

The invention relates to a device for actuating and possibly locking elevator doors, which are situated essentially one behind the other in the passage direction. These are the car door and the associated shaft door of an elevator, which come into a position one behind the other as soon as the car has correctly arrived. Typically, the car door has its own door drive unit that opens and closes it. By contrast, the shaft doors do not usually have their own drive unit. Instead, they are unlocked, actuated, and then locked again by the car door. The device according to the invention is used for this purpose.

BACKGROUND OF THE INVENTION

The patent application WO 2005/077808 has disclosed supporting the entraining skids 14, 15 of such door couplers on rotatable pivoting levers 11, 13 and driving these pivoting levers 11, 13 with the aid of the linear drive unit that opens and closes the doors and is embodied in the form of the toothed belt 106, which acts on an actuating lever 1 that rotates during normal operation. With the interposition of a likewise rotatable cam 18 and by means of an actuating or connecting rod 10, this actuating lever in turn drives the pivoting levers 11, 13—on which the entraining skids 14 and 15 are supported in rotary fashion—to rotate. By means of this, it forces the latter to execute their movement that is required for the engagement and disengagement. In addition, with the aid of the rotatable cam 18, the rotating actuating lever 1 acts on the door lock at a particular time, causing it to be unlocked. This device includes a plurality of movable components that are calibrated to one another. The position of the entraining skids 14 and 15 is determined by the other components that interact with them and cannot easily be changed.

Because of this, the already known devices of this kind incur considerable expense for system renovation.

When renovating existing elevators, it is common to continue using the existing shaft doors and the same is basically true in many cases for the cars, which are often equipped only with new car door drive units. In this case, the problem then arises that, as described for example in WO 2005/077808, it is necessary to manufacture and keep in store a whole series of variants of one and the same door drive unit and coupling mechanism, each with different connection dimensions, in order to permit them to be easily installed into the systems being renovated and above all, without significant customization work on the job site.

The necessity to manufacture and keep in store variants of one and the same coupling mechanism incurs unnecessary expense.

The object of the invention, therefore, is to produce a corresponding device that is adjustable within broad latitudes and is thus adaptable to a wide variety of existing systems.

SUMMARY OF THE INVENTION

A device is thus proposed for synchronously actuating and locking elevator doors, which are situated essentially one behind the other in the passage direction, as represented by a car door and a shaft door of a car that has properly arrived at a stopping place.

The device includes entraining skids that are fastened to a first door by means of an entraining skid support. The entraining skid support is usually connected to a carriage either rigidly or so that it can execute relative movements a certain distance back and forth in relation to the carriage. The spacing of the entraining skids relative to each other can be changed by means of the door drive unit in order to couple the first door to the second door and to permit them to be opened and then closed again in tandem. The door drive unit is as a rule embodied in the form of a linear drive unit that moves the doors in the opening and closing directions.

According to the invention, the entraining skid support has a plurality of first openings auf, which make it possible to affix at least one, preferably both, of the entraining skids to the entraining skid support in different functional positions. These first openings are not produced at the job site. Instead, they are industrially prefabricated, i.e. they are produced as part of the series production of the entraining skid support. Typically, the openings are produced by punching.

A functional position of the entraining skid is understood to be a position in which the entraining skid can properly fulfill its intended function. In other words, the entraining skids can be mounted on the entraining skid support in different positions in order to perform their functions—depending on how the entraining skid support is mounted and the positioning of the coupling elements that are to be engaged by the entraining skids in order to produce the coupling.

This markedly reduces the amount of effort that must be exerted for a general overhaul or modernization of an existing system. This is because despite the fact that the existing systems have been erected by a whole series of different manufacturers and therefore have quite different connecting dimensions, it is largely possible to always use one and the same device to perform the coupling and uncoupling. The installer at the job site does not have to cut anything to size himself and also does not have to drill any new holes. Instead, it is sufficient for him to select a suitable installation position for the entraining skid support and then fasten the entraining skids by means of the different first sections that the entraining skid support provides for him in different positions so that the entraining skids are correctly positioned relative to the coupling elements of the passive door, which cooperate with them, and can fulfill their function.

In a preferred embodiment, the first openings constitute a field or matrix that makes it possible to affix preferably both entraining skids to the entraining skid support in different functional positions in both the vertical and the horizontal direction. A matrix is understood in this context to mean openings that are arranged in respective rows aligned in a first direction and in a second direction orthogonal to the first. A field is understood to be a group of openings correspondingly arranged next to one another, but not completely aligned in rows. Arranging the openings in a matrix has the advantage that a precise dimensional pattern can be predetermined, for example in the form of holes that are spaced apart from one another by a certain number of millimeters in the vertical and horizontal direction. Such openings can then be "counted" so to speak, in order arrive in the simplest way at a correct positioning of the entraining skids for a particular old system that is to be modernized. If, however, the first openings are organized as a field, i.e. not strictly in rows extending in two directions, but rather as more or less offset from one another, then this achieves an even greater flexibility with regard to positionability.

Ideally, the field or matrix contains at least 3×3 openings that are preferably arranged within an essentially rectangular area.

It is particularly preferable if at least some, preferably all, of the first openings are oblong holes, regardless of the possible presence of other openings for other purposes that may be differently embodied. This permits a positioning of the entraining skids that can be more or less "smoothly" adjusted across a broad range. This is particularly true if the oblong holes are of a considerable length and preferably have a length that exceeds the maximum width of the entraining skids transverse to the movement direction of the carriage.

It is particularly suitable if the entraining skid support also has a plurality of second openings, which make it possible to connect the entraining skid support in different positions to a mobile element of the linear drive unit, for example to the belt of the linear drive unit. This further increases flexibility. It is not necessary to maintain a particular position because the entraining skid support otherwise cannot be fastened to the belt without additional effort. Consequently, not only can the entraining skids be arranged in different positions on the entraining skid support, but also the entraining skid support itself can be mounted in different positions relative to the linear drive unit. To this end, the entraining skid support is preferably also provided with a plurality of third openings that make it possible to fasten it to a carriage of a door panel in different positions so that it is functionally associated with the carriage. Ideally, the third openings are embodied so that the entraining skid support can be fastened to the carriage by means of them so that it can move back and forth relative to the latter by a certain distance at a given time.

In a particularly preferred embodiment, one entraining skid is affixed to the entraining skid support in a functional position, in which this entraining skid is immobilized relative to the entraining skid support. This entraining skid is thus rigidly screw-mounted to the entraining skid support. This significantly simplifies the actuation of the entraining skids by a corresponding actuating mechanism. Only one entraining skid has to be moved. This makes it easier to provide an actuating mechanism that does not negatively affect the installation flexibility according to the invention, i.e. its own position is adjustable. This makes it possible to initially position the entraining skids without taking into account the actuating mechanism and to subsequently adapt the actuating mechanism to the installation position that has been selected for the entraining skids in the relevant individual case.

In this case, it is particularly advantageous if this entraining skid itself has more holes than are actually required for fastening it to the entraining skid support. This is because these additional holes in the entraining skid permit even greater flexibility with regard to the positioning of the entraining skid.

If, for example, the entraining skid needs to be positioned even "higher" than is permitted per se by the first sections provided on the entraining skid support, then an additional shifting can be performed by selecting other, namely lower, holes of the entraining skid in order to screw-mount the entraining skid to the entraining skid support.

Preferably, the additional holes in this entraining skid simultaneously serve to hold at least a part of the contact that provides information about whether or not the door is closed. It is therefore unnecessary, in addition to the entraining skid support, to provide different holders for the contact or the corresponding component of the contact.

Preferably, only one entraining skid is affixed to the entraining skid support in a functional position in which the entraining skid is mobile relative to the entraining skid support. The actuating mechanism that is used for coupling and uncoupling therefore only has to act on this one entraining skid.

Preferably, this mobile entraining skid is affixed to the entraining skid support by means of at least two pivoting levers. Each of the pivoting levers has a first mobile bearing with a first axle, which connects it to the entraining skid, and a second mobile bearing with a second axle, which connects it to the entraining skid support. The decisive point is that the first openings of the entraining skid support make it possible to affix the two second axles to this support in different functional positions.

In addition, the mobile entraining skid itself preferably has more holes than are actually required for fastening the two first axles of its first mobile bearings. This also ensures an additional degree of installation flexibility. For example, in order to place the entraining skid in a position even higher than is possible using the corresponding openings of the entraining skid support, the two first axles of the two first bearings can be detached and fastened to the entraining skid again in the other, holes situated further down. This places the entraining skid in a higher position.

It is particularly advantageous if one entraining skid—preferably the one that does not interact directly with an actuating element—directly controls the opening and closing movement of the car door bolt, for which protection is claimed, both depending on the embodiments described above and independently thereof. There is thus no direct operative connection, i.e. bypassing the entraining skids, between the car door drive unit and the car door bolt, as is the case for example in WO 2005/077808. This basic type of control of the car door bolt permits a large degree of flexibility in the positioning of the entraining skids; specifically, the possible positions of the entraining skids are not limited by the mechanism for actuating the car door bolt.

Ideally, the entraining skid that controls the opening and closing movement cooperates with a slider that is able to move in a fully or at least predominantly translatory fashion, which it moves and which is in turn coupled to the car door bolt. Such a slider can be constructed in such a way and—in particular, can be long enough—that it is always situated in the immediate vicinity of the entraining skid that is provided for actuating it, so that it does not matter where within its various possible positions the entraining skid is situated on the entraining skid support because the relevant entraining skid and the slider are always situated so close together that it is possible to produce the operative connection between them that is required for the entraining skid to be able to actuate the slider.

Ideally, the slider, which is able to move in an essentially translatory fashion, is supported on the side of the entraining skid support oriented away from the entraining skids (i.e. the back side). In this way, the slider is never in the way of the entraining skids such that it could impede the number of their possible installation positions on the entraining skid support, i.e. on its front side.

Preferably, the slider has a contact element, which is composed of a pin that can be fastened to the slider in different positions and that preferably supports a roller. Ideally, this contact element protrudes through an opening of the entraining skid support into the region of the side of the entraining skid support on which the entraining skids are situated. It is thus possible first—and with complete freedom with regard to what is possible by means of the hole pattern of the entraining skid support—to establish the position of the entraining skids in order to then produce, by appropriately positioning and immobilizing the pin (which can be affixed to the slider in different positions), the required possibility of interaction between the slider and the entraining skid that actuates it.

Ideally, the slider has a plurality of holes that are suitable for fastening the pin in different positions and are arranged one after another in a row and/or at least one oblong hole, preferably several of them. This provides a particular freedom in establishing the position of the pin.

It is particularly advantageous if the slider has a plurality of rows of holes that are situated next to one another in relation to its sliding direction and/or a plurality of oblong holes that are at least partially situated next to one another in relation to its sliding direction. This further increases the installation flexibility.

Ideally, the entraining skid that controls the opening and closing movement is not firmly coupled to the contact element or pin, but is instead embodied so that only compressive forces can be transmitted between the entraining skid and the contact element, but no tensile forces. The contact element or the pin and the slider thus only come into contact with each other and are not affixed to each other, but instead can even temporarily lift away from each other and slide or roll in relation to each other. This eliminates the need for a bearing eye or the like on the slider, which would always preset a particular position of the pin or actuating element and would thus reduce the variability.

Other advantages, possible embodiments, and functions can be inferred from the following description of an exemplary embodiment taken in conjunction with the figures.

DETAILED DESCRIPTION OF THE PREFERRED EMBODIMENTS

First Exemplary Embodiment

Figure 1:
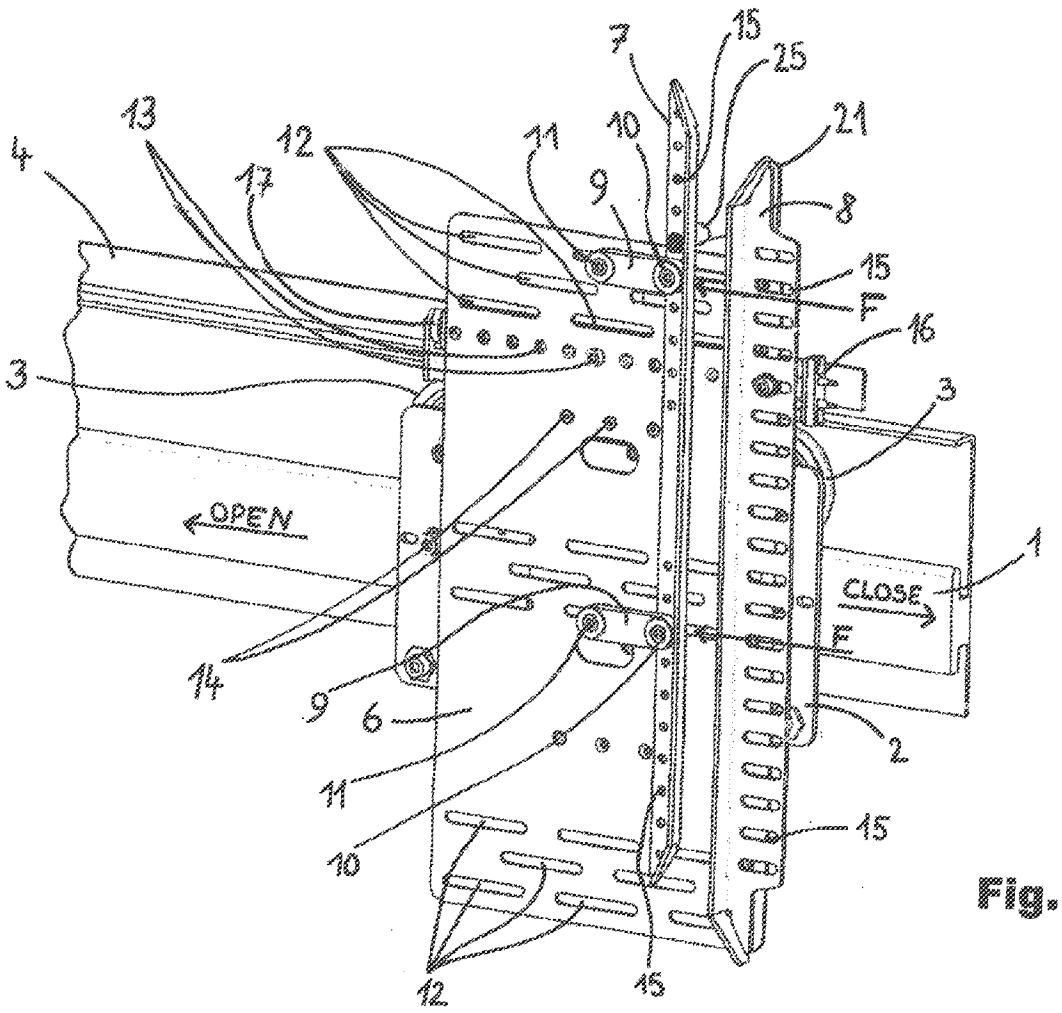
FIG. 1 shows an exemplary embodiment of the door coupler according to the invention, in the course of a closing movement, a fairly long time before the doors have reached their completely closed position.

FIG. 1 depicts the device according to the invention in a position in which the driven door that is associated with this device is connected to the non-driven door in order to entrain the latter in the opening or closing direction.

It should be noted that the device according to the invention is used for actuating sliding doors. The sliding doors can each be composed of one or more door panels that travel in series and can "telescope," so to speak, in order to open, which will not be described in greater detail below.

The drawing here clearly shows the guide rail 1, which is as a rule mounted at the top of a car so that it extends essentially in the horizontal direction.

At least one carriage 2 travels along the guide rail 1 and for this purpose, is equipped with rollers 3 on which the carriage travels along the guide rail 1. As a rule, other rollers are provided on the underside, but are not shown here. These prevent the carriage from derailing or coming unhooked. The necessary movement is provided by a linear drive unit, which is preferably a cable or drive belt 4 and which travels over a drive roller and a corresponding counterpart roller, neither of which is shown here. The so-called opening direction is the movement direction of the drive belt 4, which is indicated by the arrow marked OPEN. The so-called closing direction is indicated by the arrow marked CLOSE.

As a rule, the entraining skid support 6 is fastened directly to the drive belt 4, most often without the interposition of a loose element such as a spring or a damper. The entraining skid support 6 is preferably an at least essentially flat plate made of sheet metal. Ideally, it has a thickness of at least 1 mm.

The entraining skid support 6 in turn supports a first entraining skid 7 and a second entraining skid 8. The first entraining skid 7 of the exemplary embodiment shown here is a mobile entraining skid. This mobile entraining skid is distinguished by the fact that it is secured to the entraining skid support 6 by means of at least two pivoting levers 9 in a way that allows it to move relative to the entraining skid support. For this purpose, each of the pivoting levers 9 is fastened to the entraining skid 7 in rotary fashion by means of a first bearing 10 and is secured to the entraining skid support 6 in rotary fashion by means of a second bearing 11. Typically, each of the two above-mentioned bearings includes a bearing pin, which has a thread at its one end, by means of which it can be firmly screwed to the entraining skid support 6 and/or to the entraining skid 7.

The second entraining skid 8 of the exemplary embodiment shown here is an immobile entraining skid. This means that this entraining skid 8 is fastened and preferably screwed to the entraining skid support 6 so that it cannot move relative to the latter.

As is clearly visible in FIG. 1, the entraining skid support 6 is provided with a plurality of first openings 12, in this case, 9 each in its upper section and lower section. In the exemplary embodiment shown here, these first openings 12 constitute a field composed of a plurality of holes, ideally in the form of oblong holes, preferably situated one after another in the movement direction of the entraining skid support and a plurality thereof arranged next to each other transversely to this movement direction. In this case, it is particularly advantageous if at least three oblong holes are situated one after another per row and at least three rows of oblong holes are situated next to one another. Each of the oblong holes is preferably longer than the width of the two entraining skid supports. The oblong holes of adjacent rows are offset relative to one another, which increases the flexibility and stability of the entraining skid support.

These first openings 12 permit the two entraining skids 7 and 8 to be fastened to the entraining skid support 6 in a wide variety of positions. To this end, at least two of the oblong holes are provided with retaining screws by means of which the immobile entraining skid 8 is clamped to the entraining skid support 6 so that it is mounted there in stationary fashion. To this same end, at least two additional bearing pins are provided, which can preferably be screw-mounted into the oblong holes; they each constitute a swivel bearing for a respective second bearing 11 of the pivoting lever 9 and simultaneously keep the relevant bearing eye in position.

Bearing in mind the fact that the entraining skid support is typically at least 20 cm wide and at least 35 cm high, it is then clear that with the aid of the first openings 12, it is possible to vary the functional position of the entraining skids 7 and 8 by at least 7.5 cm in the vertical direction transverse to the movement direction and by at least 15 cm along the movement direction of the door without having to change the position of the entraining skid support 6 as such or having to produce additional holes in the entraining skid support 6 on the job site.

In order to further increase installation flexibility, each of the entraining skids is also provided with a large number of holes 15 (preferably between 12 and 24 of them). Only some of these holes 15 are needed in order to fasten the relevant entraining skid to the entraining skid support 6. Most often, only 2 are used for this purpose. In the second entraining skid 8, these holes 15 are preferably embodied in the form of oblong holes, which extend at least essentially in the direction parallel to the movement direction. In the first entraining skid 7, these holes are preferably embodied in the form of circular holes, each of which can have another bearing pin fastened or screwed to it, which belongs to a first bearing 10 that serves to fasten the pivoting levers to the relevant entraining skid 7 in pivoting fashion. The embodiment of the holes 15 in the form of oblong holes in the entraining skid that is immobile relative to the entraining skid support significantly facilitates the adjustment and elimination of the coupling play, which will be described in greater detail below.

In order, for example, to be able to mount the entraining skids 7, 8 in a position significantly higher than the one shown in FIG. 1, not only is it possible to insert the screws or second bearings 11 of the relevant entraining skid 7, 8 into other oblong holes located higher on the entraining skid support 6, it is also possible to insert the relevant screws or first bearings 10 of the relevant entraining skid 7, 8 into holes 15 located lower on the relevant entraining skid so that in this way, the relevant entraining skid ends up in a higher functional or working position.

In addition, the entraining skid support 6 is preferably provided with a plurality of second openings 13. These make it possible to fasten the linear drive unit or in the present case, its drive belt 4, to different positions on the entraining skid support 6. This also increases the installation flexibility.

Another improvement in flexibility is preferably achieved in that the entraining skid support 6 has various third openings 14, which make it possible to connect it to the carriage 2 in various positions.

It is absolutely essential to actuate at least one of the entraining skids actively in order to lift it up from the coupling sections of the entrained second door or to place it against them and thus produce the coupled state. A decisive point is then that the drive unit for the active actuation of the at least one entraining skid is embodied so that it does not absolutely force the entraining skid and entraining skid support 6, which are driven by it, to assume a particular position. Instead, the drive unit is embodied so that it is largely independent of the position in which the entraining skid that is driven by it is mounted on the entraining skid support 6 and of the position in which the entraining skid support 6 is associated with the carriage 2.

How this drive unit should hence be embodied becomes readily apparent when one considers the operation of the device according to the invention in greater detail.

Figure 2:
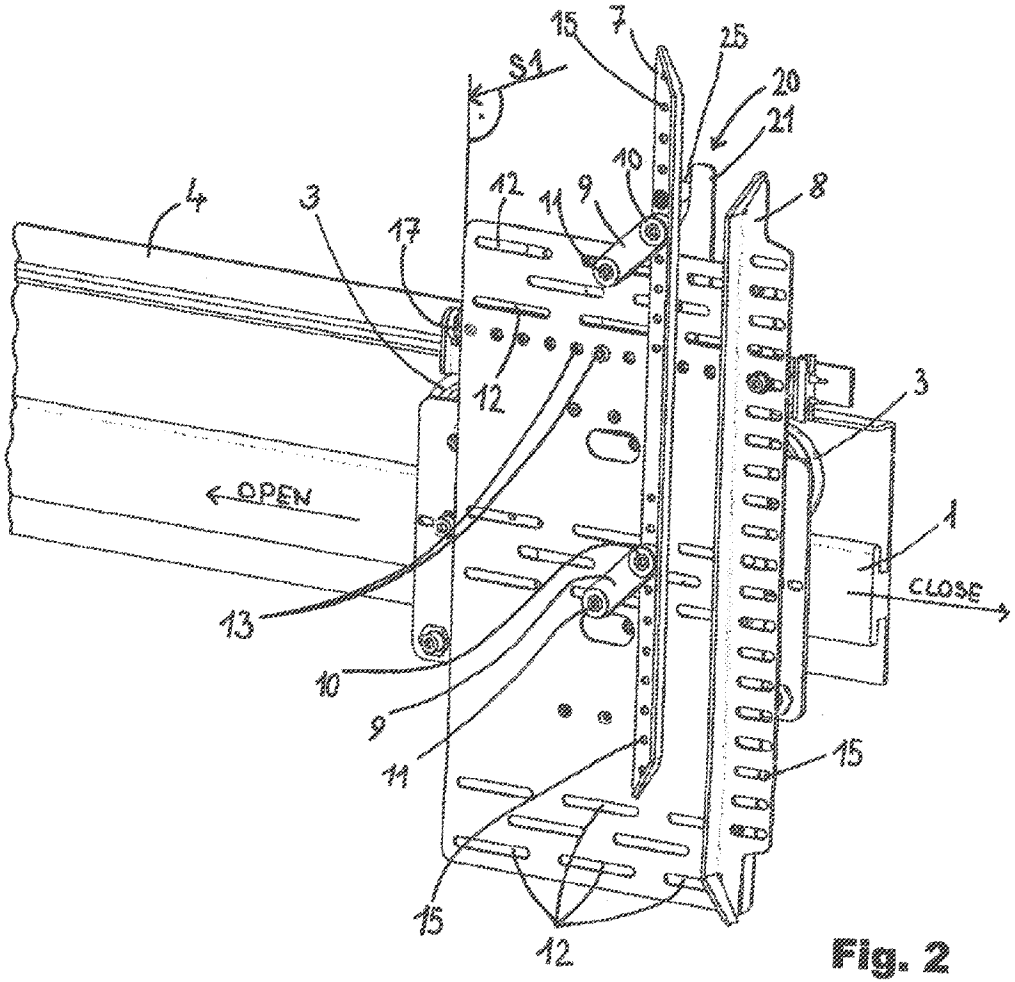
FIG. 2 shows an exemplary embodiment of the door coupler according to the invention shortly before the end of the closing movement, at a time in which the doors have just reached their completely closed position.
Figure 3:
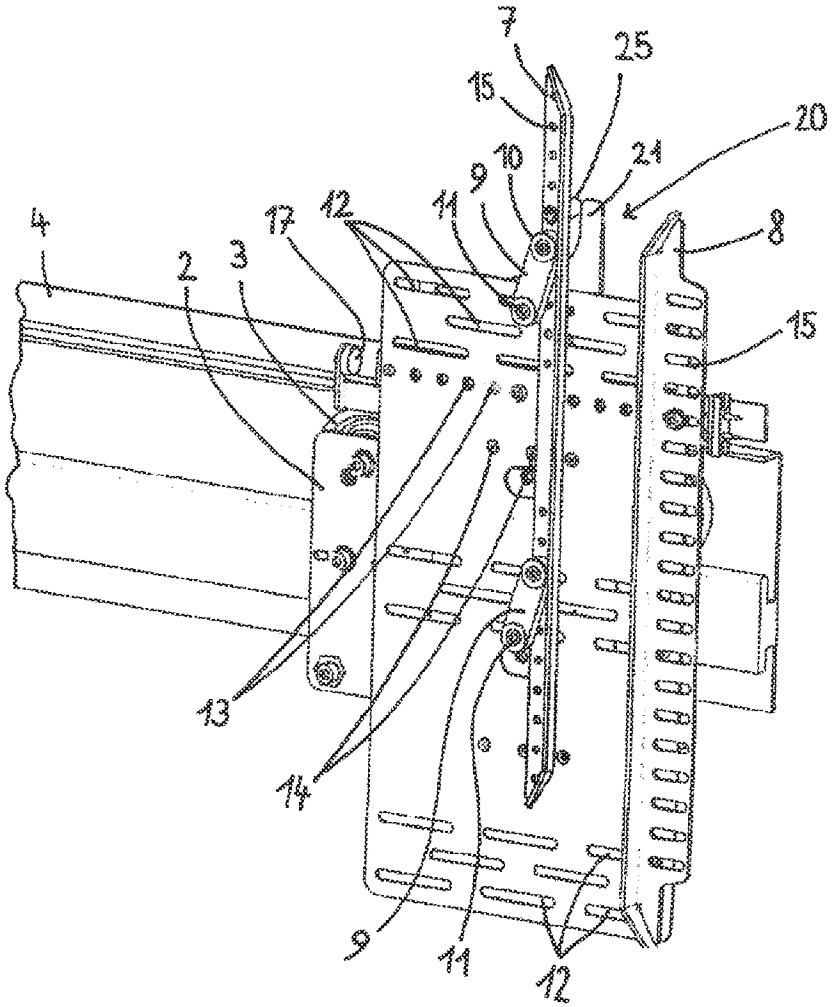
FIG. 3 shows an exemplary embodiment of the door coupler according to the invention at the very end of the closing movement, at a time in which the entraining skids have already completely opened again.

The operation of the device according to the invention can best be seen by considering FIGS. 1 through 3 in sequence and FIGS. 4 through 8, which respectively correspond to them.

FIG. 1 shows a snapshot in which the carriage 2 of the door panel and the entraining skid support 6 are affixed to each other. They move in tandem in the closing direction, in the direction of the arrow marked CLOSE.

As a rule, the door panel associated with the carriage 2 is fastened in the vicinity of the lower section of the carriage 2. It hangs downward from there. The door panel, however, is not shown in FIG. 1 for the sake of better visibility.

The carriage 2 and the entraining skid support 6 are immobilized relative to each other by means of the securing coupling 17. This securing coupling 17 is preferably a magnetic clamp. This coupling is fastened to one of the two above-mentioned components and magnetically attracts the other component. Alternatively, it is naturally also possible to use an electromagnet here or another holding means such as a snap-lock coupling, which can only be disengaged by overcoming the specified holding forces.

In this movement phase, the two entraining skids 7 and 8 are in their driving position. In the driving position, they generally rest without play against the coupling elements of a door (usually a shaft door) that is to be entrained by them.

By means of the above-described openings of the entraining skid support 6, the entraining skids are preferably positioned on the entraining skid support 6 so that in this movement phase, the pivoting levers 9—due to the reaction forces, which act on the entraining skid 7 and tend to push it in the opening direction—are not or essentially are not acted on by a torque acting in the opening direction. The two resultants of these reaction forces are each indicated by means of an arrow F in FIG. 1. The decisive factor in this exemplary embodiment is that the entraining skid 7 is positioned so that the central axes of its two bearings 10 and 11 essentially lie on the same line, which is oriented parallel to the movement direction. In this way, the reaction forces, which are each symbolized by an arrow F, extend through the center points of the two bearings and in this way, do not exert torque on the pivoting lever 9.

Advantageously, at least one spring is provided, which elastically prestresses the entraining skid support toward its driving position. This spring is not visible in FIG. 1 because it is preferably situated and suspended on the back side of the entraining skid support.

It should also be noted in connection with FIG. 1 that a part of the door contact 16 is positioned on the entraining skid that is situated directly on the side of the door gap. The purpose of this is to provide information at all times regarding whether the door is completely closed or is completely or partially open.

The actuating element 20 is almost invisible in FIG. 1. The only part of the actuating element 20 that is visible here is a small part of the actuating section 21 and the roller 25, which is fastened to the entraining skid 7 (with the aid of a bearing pin that preferably has a thread at one end). This roller is provided to interact with the actuating element 20 and with its actuating section 21. The arrow S1 shown in FIG. 2 symbolizes the viewing direction of the observer when looking at FIG. 4, which is associated with FIG. 1.

Figure 4:
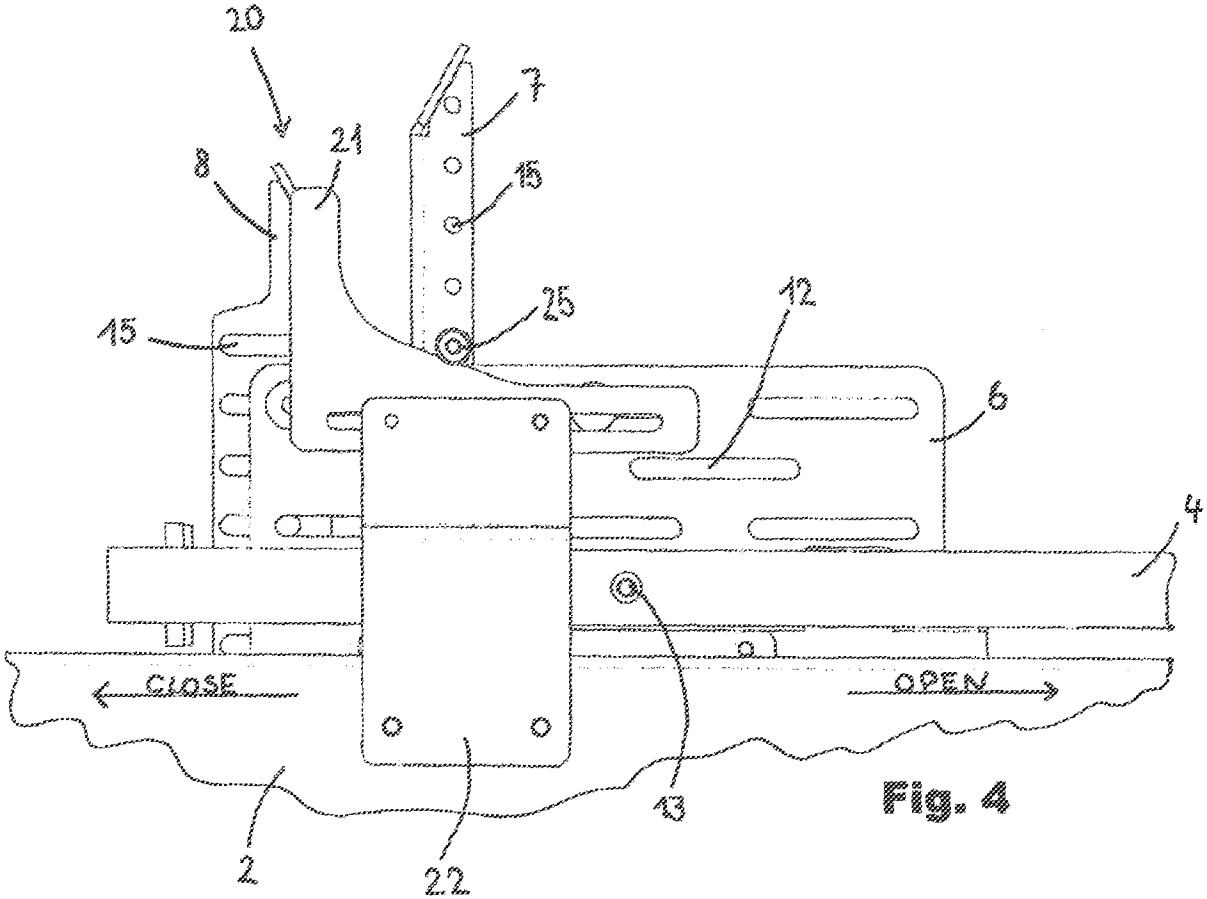
FIG. 4 shows the actuating mechanism that is hidden in FIG. 1, in the phase that is shown in FIG. 1; the viewing direction in FIGS. 4 through 7 is indicated by the arrow S1 in FIG. 2.
Figure 5:
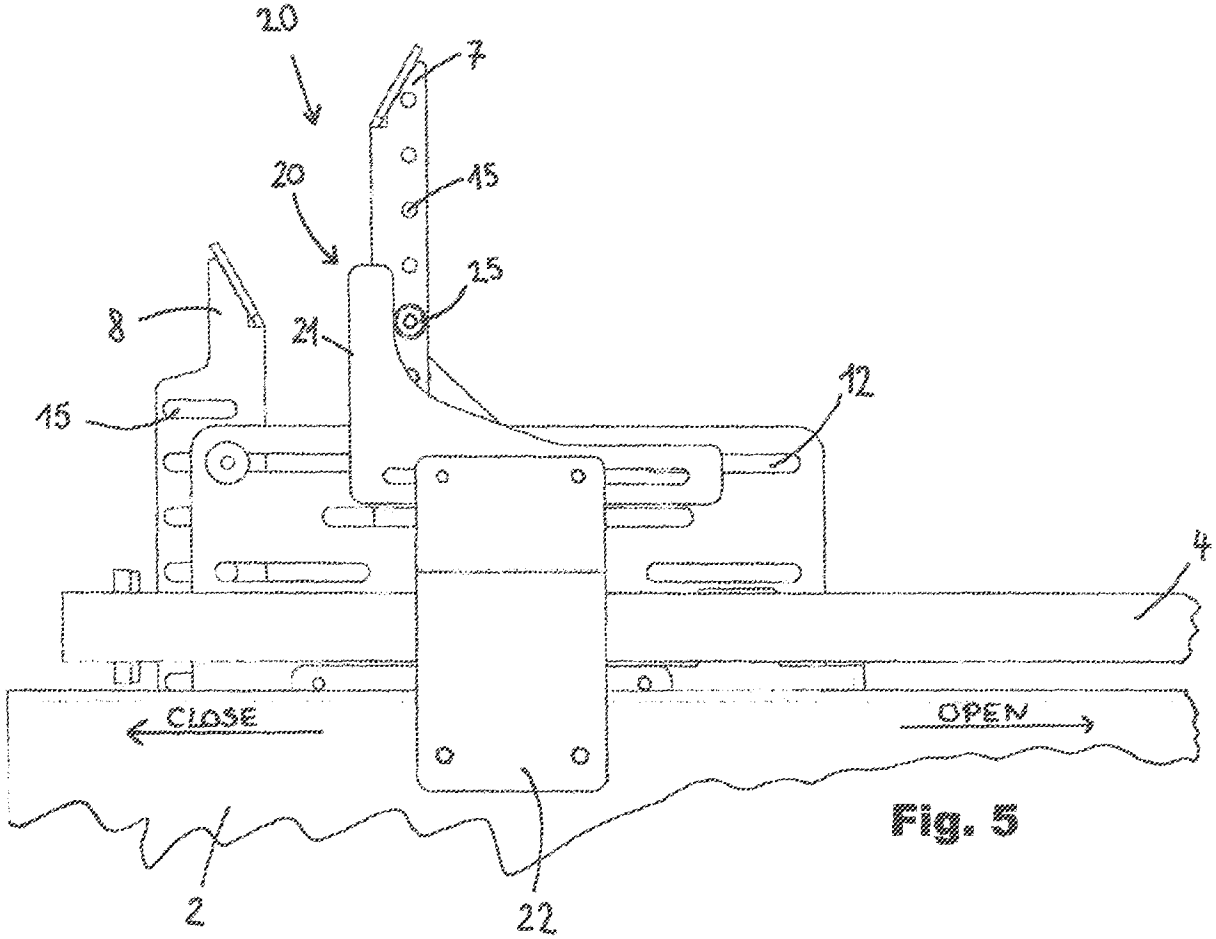
FIG. 5 shows the actuating mechanism that is largely hidden in FIG. 2, in the phase that is shown in FIG. 2.
Figure 6:
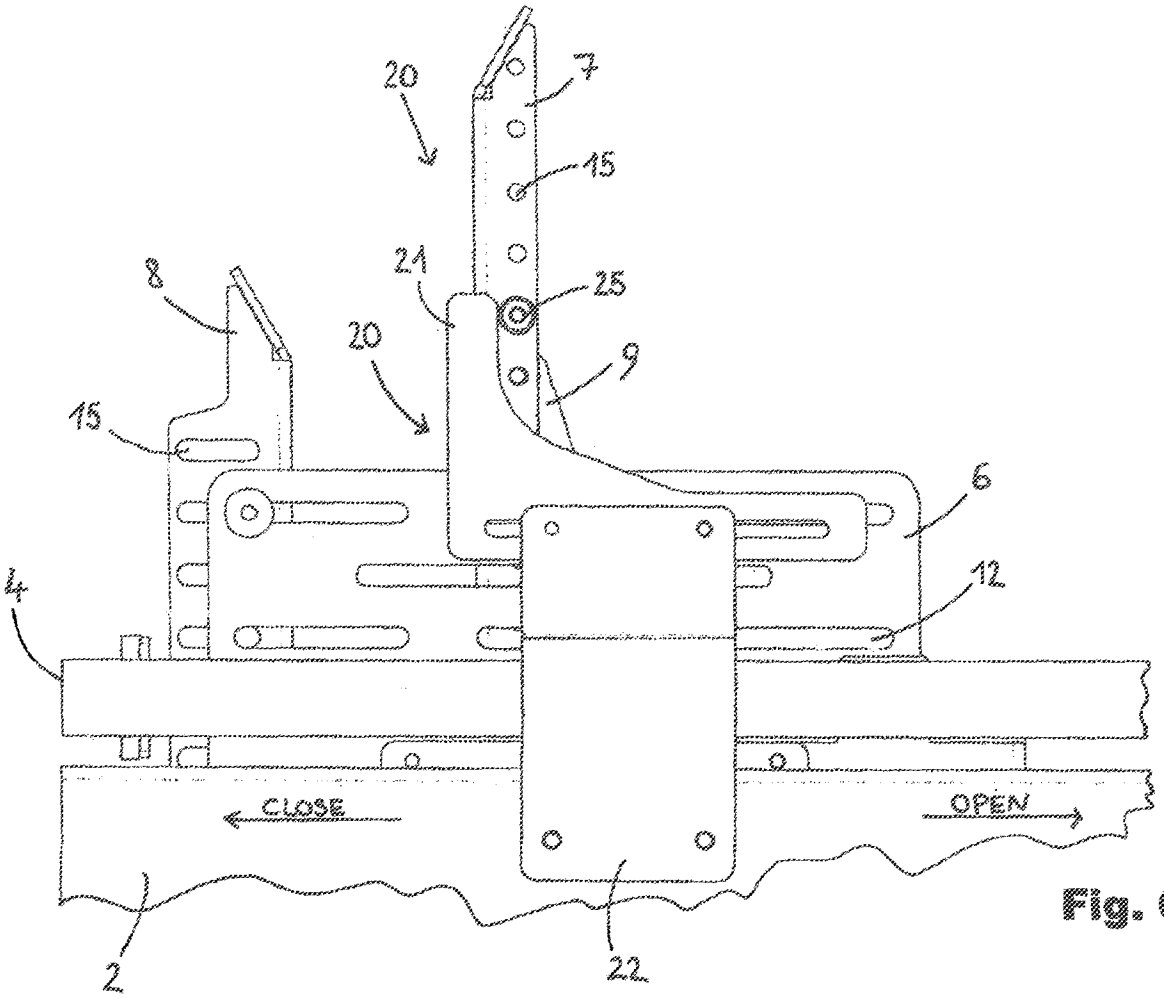
FIG. 6 shows the actuating mechanism that is largely hidden in FIG. 3, in the phase that is shown in FIG. 3.

FIG. 4 clearly shows the actuating element 20, which is used to couple and uncouple the entraining skids 7, 8. As is evident, the actuating element 20 is composed of an actuating section 21 and a holding section 22 that is preferably screwed to it. For reasons that will be explained in greater detail below, the actuating section 21 is connected to the holding section 22 with the aid of one or more different holes, ideally one or more oblong holes, as shown here. The holding section 22 is in turn generally connected to the guide rail 1 in an immobile fashion, which is symbolized in FIG. 4 by the two screw ends that are not depicted in greater detail. In principle, it is possible to provide oblong holes here as well in order to be able to adjust the position of the holding section. FIG. 4 also shows the drive belt 4 and the back side of both the entraining skid support 6 and the entraining skids 7 and 8.

Figure 7:
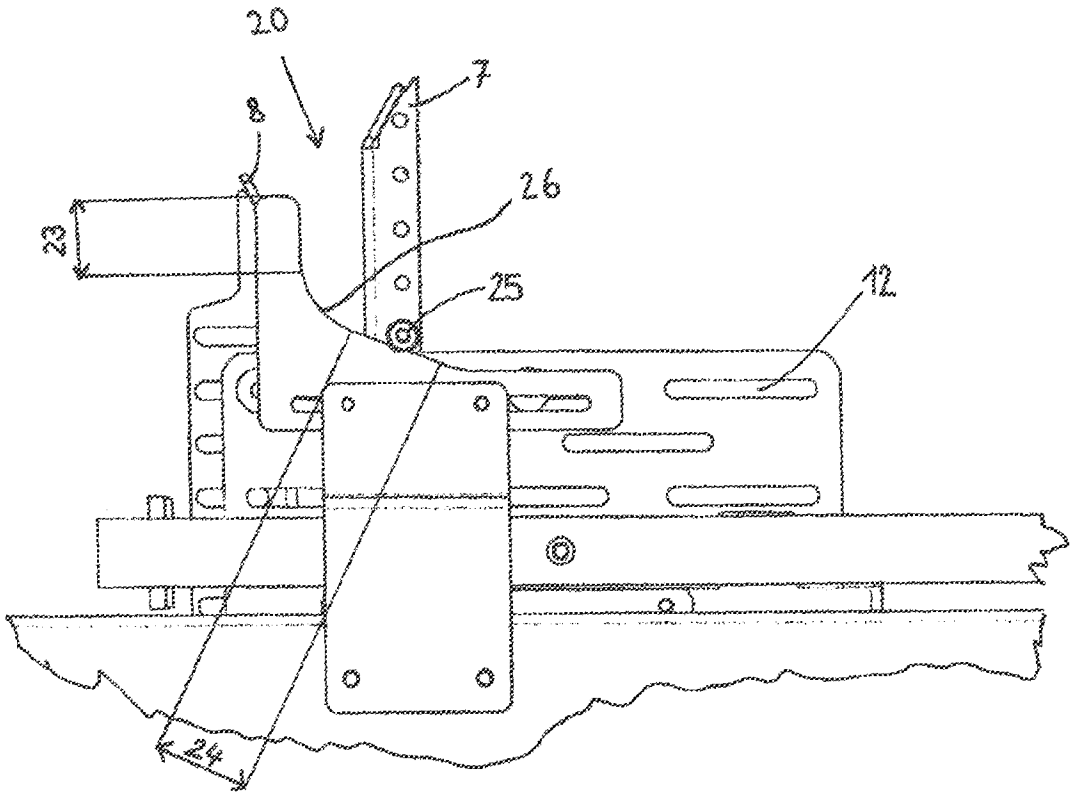
FIG. 7 corresponds to FIG. 4 and is provided to aid in the description of details of the actuating section 21.

The different functional sections of the actuating section 21 can be seen by taking a quick look at FIG. 7. The actuating section 21 has a section that can be referred to as the "wedge" 24, which transitions by means of a rounded section 26 into a section that can be referred to as the "stopper" 23. The above-mentioned roller 25, which is supported on the entraining skid 7 in rotary fashion, travels back and forth along this wedge, the rounded section, and the stopper during an opening and closing cycle.

FIG. 2 shows a snapshot at a point in time after the one shown in FIG. 1.

The carriage 2 of the door panel and the entraining skid support 6 affixed to it have now moved a fair distance further into the closed position, compared to the position shown in FIG. 1, i.e. in the direction of the arrow marked CLOSE. Because of this, the entraining skid support 6 has traveled a fair distance (toward the right) past the actuating element 20, of which only the actuating section 21 is visible in FIG. 2. As a result, the roller 25 that is secured to the mobile entraining skid 7 in rotary fashion has in the meantime traveled on the actuating section 21, along its wedge 24, via the rounded section, until it has reached the region of the stopper 23, also see FIGS. 5 and 7. As a result, the mobile entraining skid 7 has already been lifted a fair distance up by the wedge 24 and has as a result simultaneously slid relative to the entraining skid support 6 in the direction of the OPEN arrow. Consequently, at the moment shown in FIG. 2, the entraining skid 7 begins to disengage from the coupling elements of the shaft door that has been entrained up to this point. At this time, the shaft door and the entrained door have just reached their completely closed position.

FIG. 3 shows a snapshot at a point in time even later than the one shown in FIG. 2.

If the relative position between the carriage 2 and the entraining skid support 6 shown in FIG. 3 is compared to what is shown in FIG. 2, it becomes even clearer that the driven door and the entrained door, even before the entraining skid support has reached its position shown in FIG. 3, have already reached their closed position and have thus come to a stop.

But since the entraining skid support 6 is supported in a mobile fashion relative to the carriage 2, after the overcoming of the forces of the magnetic clamp, which in this case constitutes the securing coupling 17, the drive belt 4 is still able to move the entraining skid support 6 a certain distance in the closing direction along the arrow marked CLOSE. After the entraining skid 8 moves together with the entraining skid support 6, it is thus dissociated from the coupling sections of the door that is to be entrained.

In the course of moving farther, the entraining skid support 6 has simultaneously moved even further in the closing direction past the actuating element 20 and its actuating section 21. But since the stopper 23 of the actuating section 21 has prevented any further movement of the entraining skid 7 in the closing direction (see FIG. 6), the entraining skid 7 has therefore been pivoted into its completely open position. The coupling sections of the door to be entrained have thus been completely released and are no longer connected to the entraining skids 7 and 8. The car can then begin its trip.

It has already been mentioned above that the actuating section 21 is preferably connected by means of one or more holes or oblong holes to its holding section 22, which is in turn firmly fixed or possibly even screwed to the guide rail 1 by means of one or more oblong holes. This plurality of holes or oblong holes makes it possible to fix the actuating section 21 in different positions. Because of this (unlike in the prior art), the actuating element 20 also does not absolutely force the entraining skids 7, 8 and/or the entraining skid support 6 to assume a particular position. It is therefore largely unnecessary to take the actuating element 20 and its position into consideration. Instead, the various holes and oblong holes can be used to install the entraining skid supports 6 and the entraining skids 7 in the position that is required in order to adapt the device to the circumstances that occur due to the modernization. Only then is it necessary to attend to the actuating element 20 and install it in a position that ensures a proper operation.

For the sake of completeness, it should be noted that the mobile entraining skid does not absolutely have to be guided on pivoting levers 9. It is also alternatively conceivable here to support the mobile entraining skid 7 in mobile fashion on the entraining skid support 6 by virtue of the fact that the mobile entraining skid 7 has slots in which fixed bearing pins travel. Details about what such a slot-guided bearing can look like can be inferred from the previously published European patent application EP 2 287 104, which is incorporated in its entirety into the present description by reference.

Figure 8:
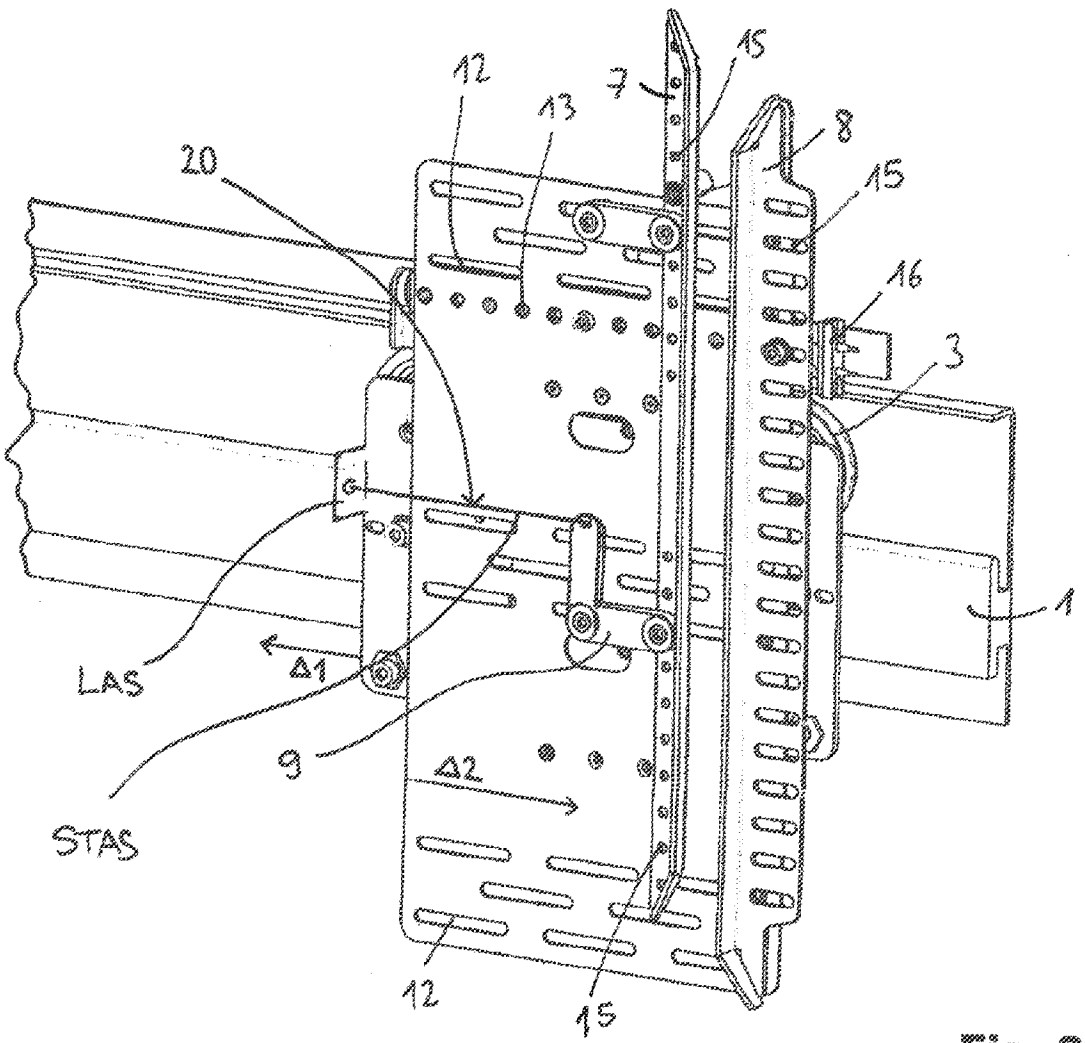
FIG. 8 shows an alternative actuating mechanism and in this regard, a second exemplary embodiment.

It should also be noted that the actuating element 20 can likewise be embodied in a way that is entirely different from the example described above. It is thus easily possible to embody the actuating element 20 as a control cable that is actuated by the carriage 2, for example at the moment in which it separates from the entraining skid support and begins to move relative to it. FIG. 8 shows the simplest case of such an alternative design.

One of the pivoting levers 9 in this case is L-shaped, i.e. is embodied in the form of an elbow lever. A STAS® brand steel cable is connected to the lever arm oriented away from the entraining skid 7. The other end of the steel cable is connected, for example, to a link LAS that is provided for this purpose on carriage 2. As described above, toward the end of the closing movement, the entraining skid support moves relative to the carriage, see Δ1 and Δ2. The resulting tautening of the STAS® brand steel cable, which has been selected to be of an appropriate length, produces a cable force that acts on the above-mentioned other end of the elbow lever and as a result, in any case produces a torque that lifts the entraining skid. A similar result, but that is even more independent of the position can be achieved with a Bowden brand cable, the core of which is connected to a lever 9 at one end at the other end, is connected to the carriage 2, while the sleeve of the Bowden brand cable is fastened to the entraining skid support (not graphically depicted).

Figure 14:
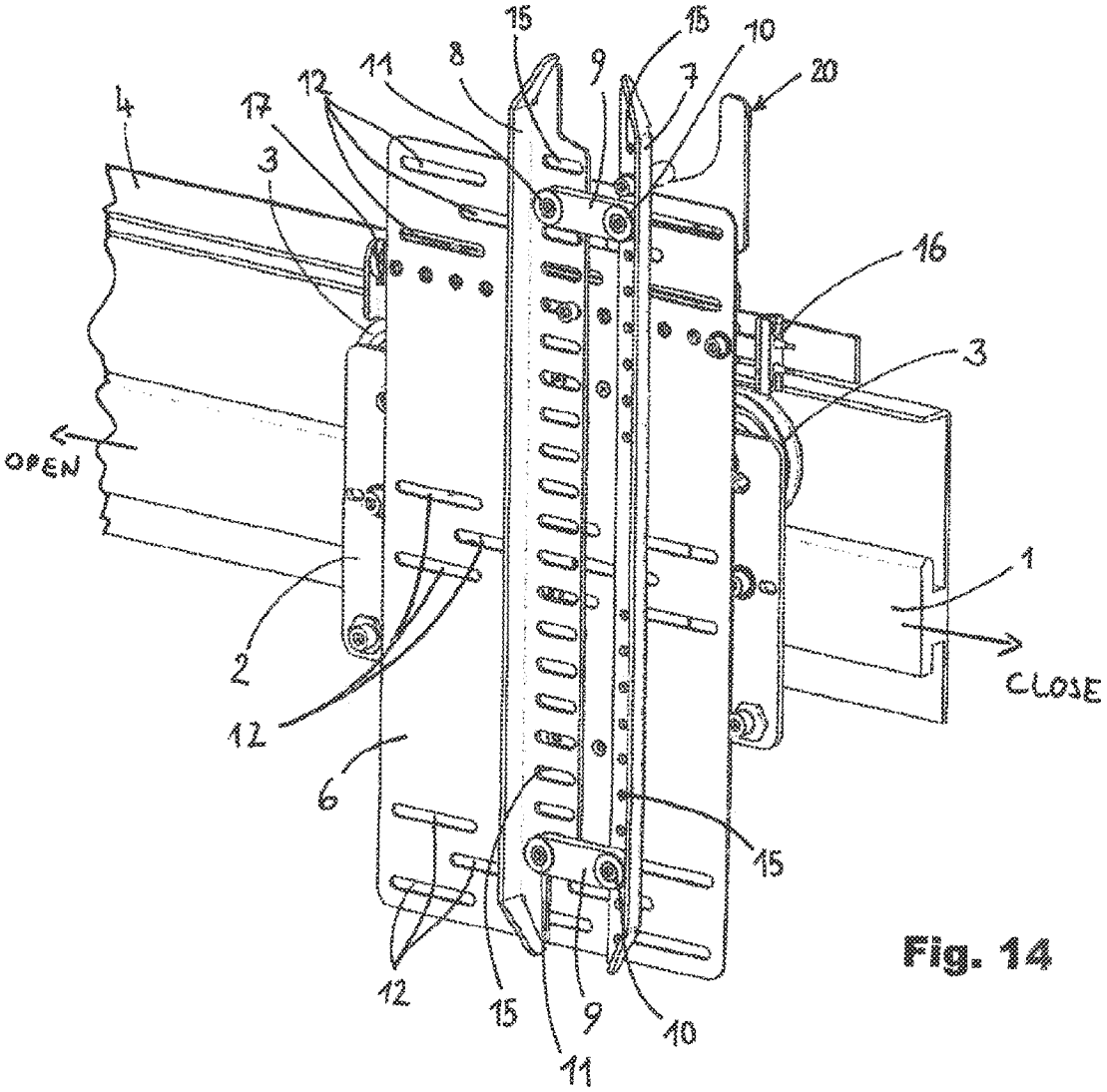
FIG. 14 shows a variant (another version) of the first exemplary embodiment.

FIG. 14 discloses another variant of this first exemplary embodiment.

The above descriptions apply identically for this variant, with one single exception:

In this variant of the first exemplary embodiment, the two entraining skids 7 and 8 are embodied as externally coupled rather than internally coupled. In other words, the coupler elements and coupler rollers 36 of the shaft doors, which are not shown in FIG. 14 per se, are not clamped internally, in the middle between the two entraining skids 7 and 8. Instead, the entraining skids 7, 8 splay open from inside between the coupler rollers 36 and actuate them, or more precisely stated, entrain them in this way. To this end, this variant is provided with a mobile entraining skid 7 and preferably an immobile entraining skid 8. The mobile entraining skid is in turn secured to pivoting levers 9 whose first bearing 10 is connected directly to the entraining skid 7 and whose second bearing 11 is connected directly to the entraining skid support 6. Preferably, the special feature shown in FIG. 14 is implemented, namely the fact that the screw and bearing pin of the second bearing 15 extend through the immobile entraining skid and in this way, simultaneously serve to fasten the immobile entraining skid.

In addition, the variant shown in FIG. 14 deviates from the one described first in that the immobile entraining skid is no longer situated toward the front viewed in the closing direction, but instead toward the back. The mobile entraining skid and the immobile entraining skid have therefore switched places, so to speak.

It should once again be noted, however, that the mobile entraining skid 7 is actuated in exactly the same way as previously described: it comes into contact with an actuating element 20 of the kind that has already been described above, which is stationary, but can as a rule be mounted in different positions.

The positioning variability of the entraining skids is present here in exactly the same way as described above for the first variant.

It is also particularly noteworthy that the extraordinary positioning variability that is the subject of the invention makes it possible for all of the essential components (in particular the entraining skid support, the entraining skids, and the actuating element as well as preferably also the pivoting levers) to be embodied so that without any change in their physical properties and purely by means of a different assembly, they can be embodied so as to produce the device shown in FIGS. 1 through 3 as a finished product and also so that they produce the device shown in FIG. 14 as a finished product. This emphasizes the significant advantage that the invention achieves because it significantly reduces the stock-keeping and the number of different devices that must be carried along to a modernization project and that are required in order to be able to immediately take into account the circumstances that are found on site.

It should be noted in general with regard to the above-described exemplary embodiments and in addition to them, that it is a very advantageous aspect to convert a relative movement between the entraining skid support and the carriage 2 that is functionally associated with it into a movement with a lifting/raising action, which causes the one or more entraining skids to release the coupling elements of the second door that is entrained by them.

Second Exemplary Embodiment of the Invention

The second exemplary embodiment of the invention is distinguished by the fact that in addition, a locking of the car door is provided and that the immobile entraining skid 8 that is preferred in the first exemplary embodiment is now made mobile and thus becomes the second mobile entraining skid **8*a***, which in turn acts directly on the car door bolt and in so doing, controls the raising and lowering thereof. Otherwise, the first and second exemplary embodiment are structurally identical so that the descriptions given for the first exemplary embodiment also apply to the second exemplary embodiment, provided that nothing to the contrary is dictated by the above-mentioned difference.

Figure 9:
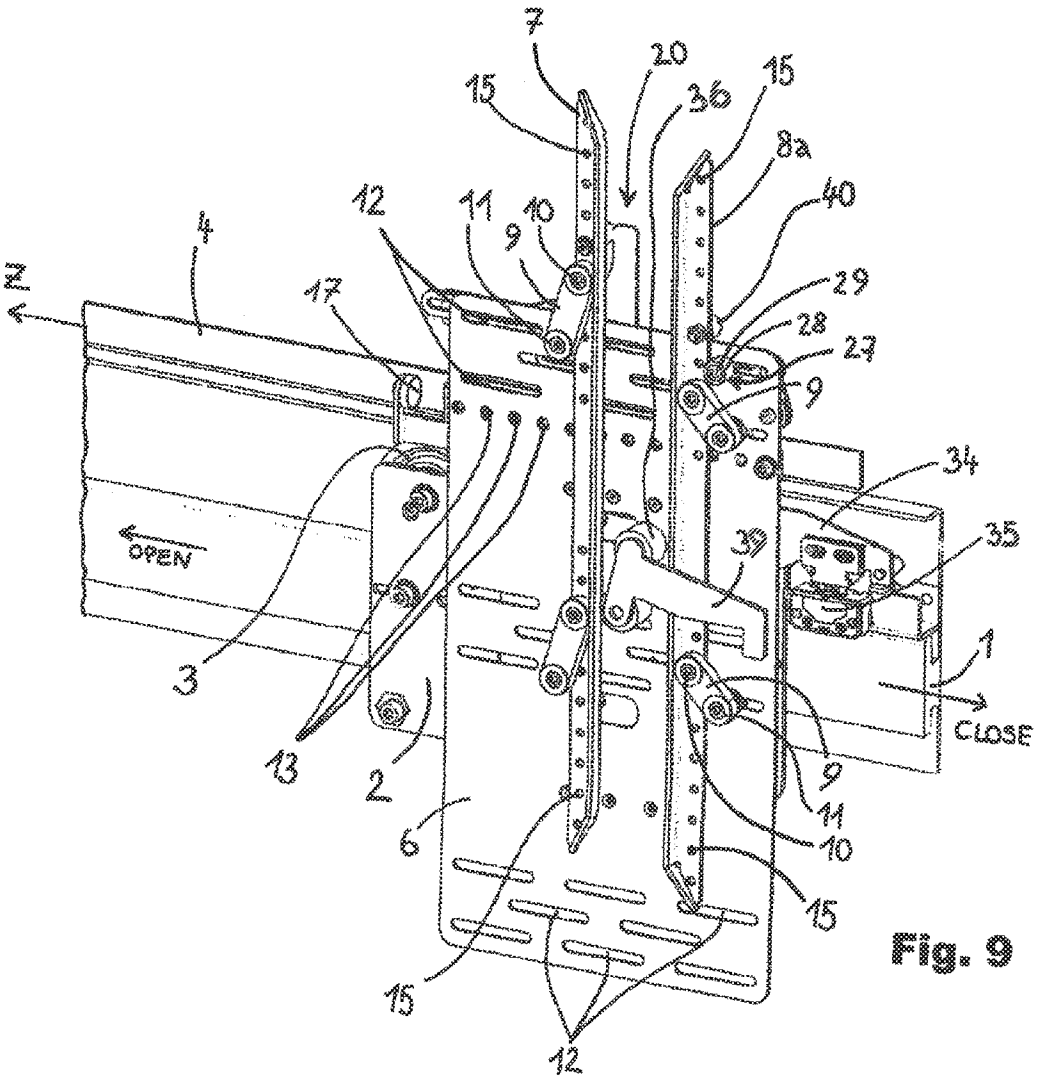
FIG. 9 shows a second exemplary embodiment of the door coupler according to the invention, at the very beginning of the opening movement, at a time in which the entraining skids are still completely open, i.e. are not yet coupled to the shaft door.

FIG. 9 is the counterpart to FIG. 1 and shows the second exemplary embodiment in a position in which the driven door that is associated with this device is connected to the non-driven door in order to entrain the latter in the opening or closing direction.

The descriptions given above for the first exemplary embodiment apply with regard to the guide rail 1, the carriage 2, and the entraining skid support 6.

Here, too, the entraining skid support 6 supports a first entraining skid 7 and a second entraining skid **8*a*. The first entraining skid 7 is embodied in exactly the same way as described for the first exemplary embodiment and it is also moved by an actuating element 20** from its raised position into its closed position and vice versa in exactly the same way.

Unlike in the first exemplary embodiment, however, the second entraining skid **8*a* is also embodied as a mobile entraining skid. The second entraining skid 8*a* is also secured to the entraining skid support 6 by means of at least two pivoting levers 9 in a way that allows it to move relative to this entraining skid support. To this end, each of the pivoting levers 9 is fastened to the entraining skid 7 in rotary fashion by means of a first bearing 10 and is secured to the entraining skid support 6 in rotary fashion by means of a second bearing 11. Typically, each of the two above-mentioned bearings 10, 11 has a bearing pin that has a thread at its one end, by means of which it can be securely screwed to the entraining skid support 6 and to the entraining skid 7, preferably in different positions of one and the same oblong hole of the entraining skid support 6 or in different holes of the various ones that are provided for this purpose in the entraining skid support so that the second entraining skid 8*a* can be fastened to the entraining skid support 6 in exactly the same variable fashion relative to the latter as described above for the first entraining skid 7**.

The mechanism for actuating the car door bolt utilizes the relative movement between the entraining skids 7, 8*a* and preferably the relative movement of the second entraining skid 8*a* and the entraining skid support in order to actuate a slider 30, which in turn provides for the lifting and continued sliding of the car door bolt. The significant advantage that can be achieved as needed with such a slider 30 is that the slider 30 can be actuated from very different positions, which is why it also does not require any particular position in which the entraining skids must be mounted on the entraining skid support. Despite the additional car locking, the device therefore retains its extraordinarily wide range of adjustability.

It is first necessary to refer to FIG. 9. It is noteworthy that the contact element 27, which preferably rests against the flank of the entraining skid 8*a* oriented away from the coupler rollers 36 of the shaft door and is acted on by it with a compressive force at the appropriate time. In this exemplary embodiment, the contact element 27 is embodied as a roller 28, which rotates on an axle 29. The contact element 27 or the axle 29 that constitutes a part of the contact element 27 reaches through an oblong hole provided for this purpose, which is ideally one of the openings 12 for fastening the entraining skids 7, 8*a*, and through the entraining skid support 6 and on the back side of the entraining skid support 6 oriented away from the entraining skids, is connected to the actuating mechanism that is mounted there for the car door bolt 34.

Figure 12:
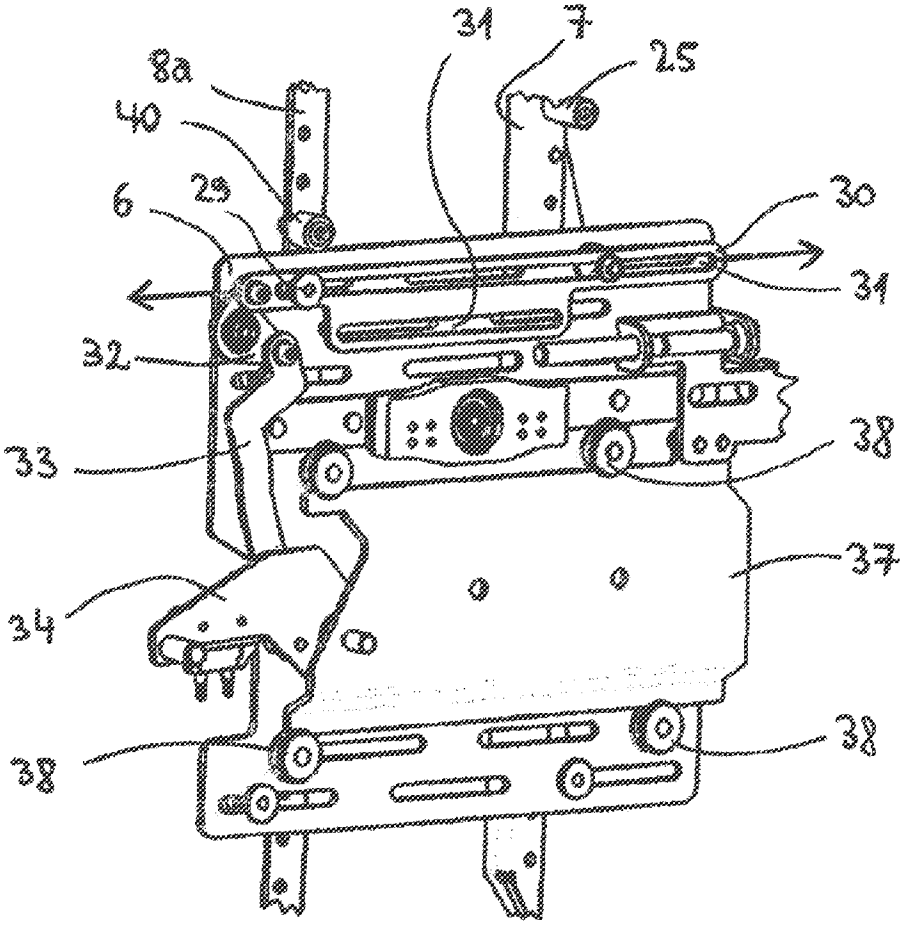
FIG. 12 shows a first version of the mechanism that is used for actuating the car door bolt in the second exemplary embodiment.

For comprehension of the structural design and function of the actuating mechanism, it is best to now consult FIG. 12.

This figure shows the entraining skid support 6 from behind, i.e. viewed from its side oriented away from the entraining skids 7, 8*a*. The drawing here clearly shows the lock support 37, on which the entraining skid support 6 is supported in a transversally sliding fashion by means of rollers 38. As a rule, the lock support 37 is an integrally or permanently installed component of the carriage that is not shown per se in FIG. 12. FIG. 12 does, however, show the two holes provided approximately in the center of the lock support 37 for mounting the lock support 37 to the carriage with screws.

The core of the actuating mechanism is the slider 30. The slider 30 has at least one oblong hole 31, which preferably extends over more than half and better still more than ⅔ of the length of the slider 30 measured parallel to its movement direction. Preferably, the slider has a plurality of such oblong holes arranged in parallel and next to one another, as shown in this exemplary embodiment, so that the bolt can be fastened to the slider in different positions in both the vertical and horizontal directions. For the sake of completeness, it should be noted that instead of the very long oblong hole(s), it is also possible to use a plurality of shorter oblong holes or even cylindrical holes, thus enabling an incrementally different positioning, but this is not graphically depicted here. The axle 29 mentioned above is affixed in the at least one oblong hole of the slider 30.

It is clear that the slider that is used to actuate the car door bolt does not require any particular position of the entraining skids on the entraining skid support. Instead, the entraining skids, as has already been described in connection with the first exemplary embodiment, particularly through the use of the openings 12 and the holes 15, can be fastened to the entraining skid support 6 in exactly the position that it must assume in order to be able to correctly cooperate with the shaft doors of the existing system. Then the contact element 27 or its axle 29 is inserted into the relevant at least one oblong hole 31 and fastened there so that the entraining skid 8*a* can actuate the contact element 27.

FIG. 12 also clearly shows a reversing mechanism 32 that is supported on the entraining skid support 6 in pivoting fashion and in this specific instance, is embodied in the form of a rocker. The reversing mechanism 32 is connected in rotary fashion to a control rod 33 on the one hand, which lifts the car door bolt 34 or allows it to fall, and on the other hand, is connected in rotary fashion to the slider 30. The reversing mechanism thus constitutes one of the two retaining bearings of the slider 30.

The other retaining bearing of the slider is likewise shown in FIG. 12: it can be a corresponding extension of the bearing 11 of the pivoting lever, which is involved in supporting and guiding the first entraining skid 7. A component of this bearing can be a pin end that protrudes freely beyond the back side of the entraining skid support and protrudes through the oblong hole 31 of the slider 30 and guides it, usually together with a correspondingly embodied nut.

The slider 30 is thus preferably supported so that it is able to move in a predominantly translatory fashion in the direction of the opening and closing movement of the door panels (see the indicating arrows in FIG. 12) and only executes a negligible pivoting movement due to being attached at one end to the reversing mechanism 32 or the rocker that constitutes it.

Figure 10:
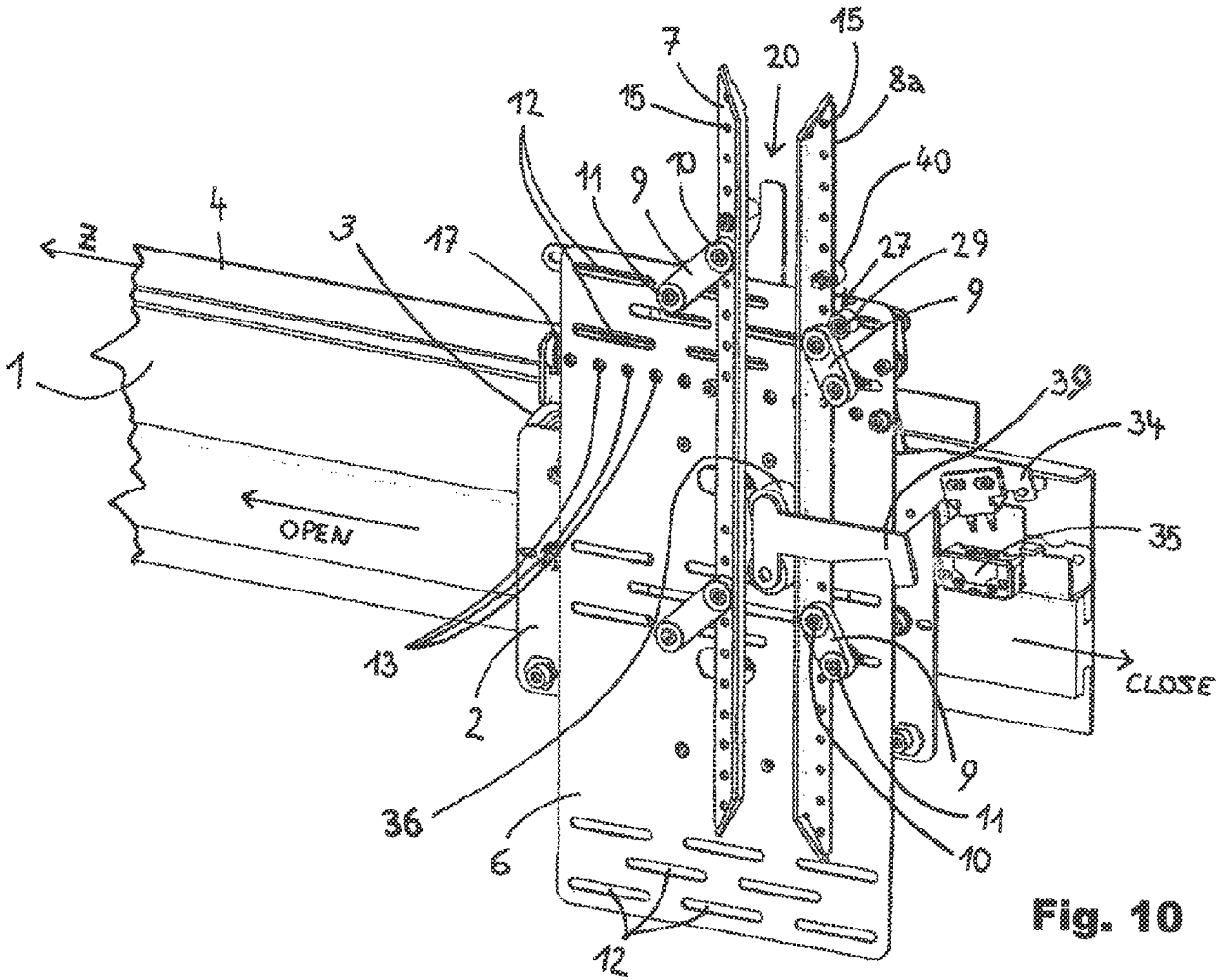
FIG. 10 shows a second exemplary embodiment of the door coupler according to the invention, just before the complete coupling of the entraining skids to the shaft door.
Figure 11:
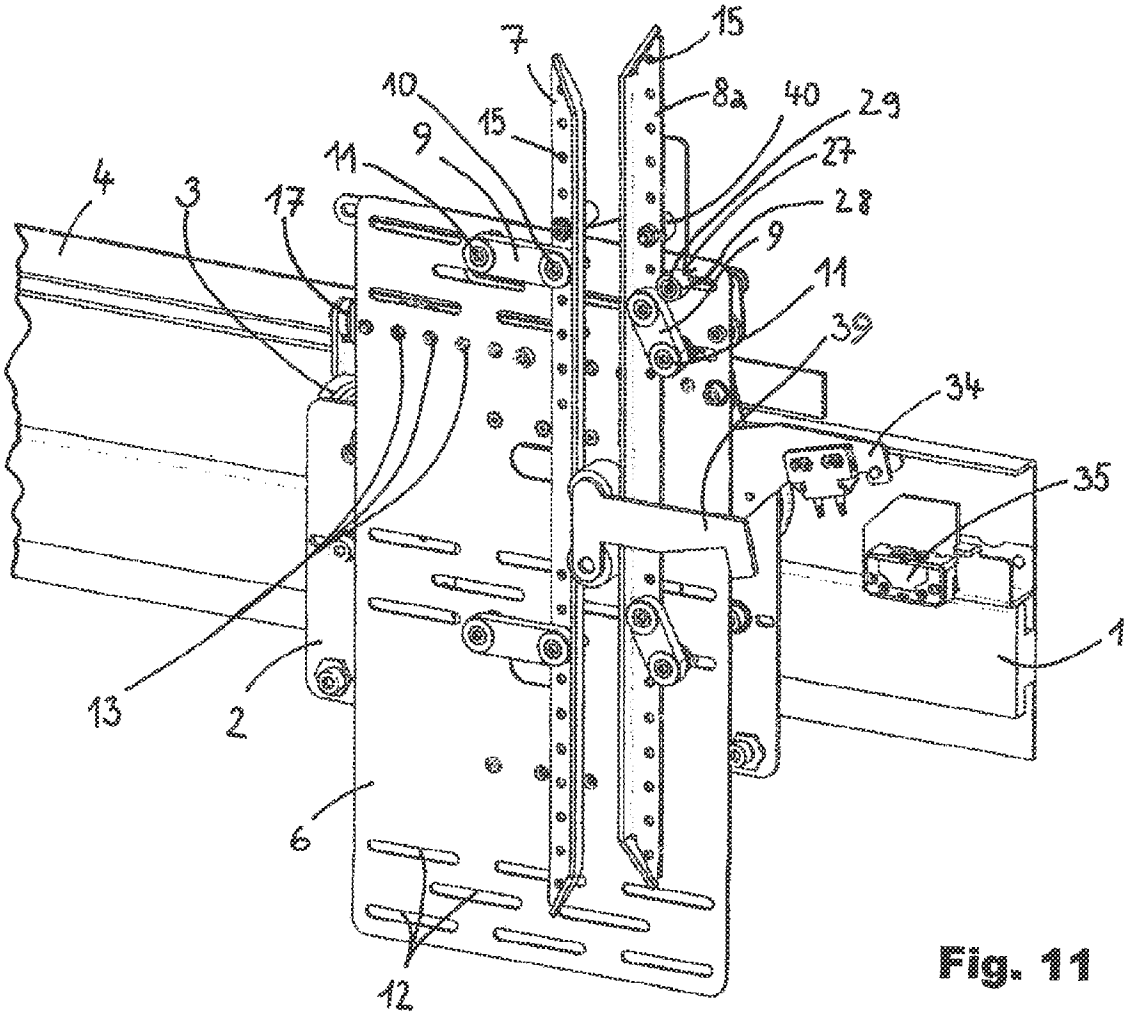
FIG. 11 shows a second exemplary embodiment of the door coupler according to the invention in a state in which the car door and the shaft door are completely coupled to each other and are moving together in the opening direction.

The precise operation of the actuating mechanism is best understood by looking at FIGS. 9 through 11 and watching what happens when the completely closed car doors and shaft doors begin to open.

FIG. 9 shows a snapshot in which the shaft door and naturally along with it, the car door as well (both not graphically depicted per se) are still completely closed. In this case, the car door is not only closed, but also locked because the car door bolt 34 is still in its latch 35.

The drive unit that is responsible for the opening of the doors nevertheless begins to move and thus produces a tensile force Z acting on the drive belt 4 in the opening direction. Since the drive belt 4 is affixed to the entraining skid support 6, it forcibly imparts a movement in the direction of the arrow Z to the entraining skid support 6, which the latter can execute despite the fact that at this stage, the door panels still remain in the closed position, since it is supported in sliding fashion relative to the relevant carriage 2 and the lock support that is as a rule rigidly connected to the latter. The respective second bearings 11 of the two pivoting levers 9 move together with it in the direction of the arrow Z. The second entraining skid 8*a* then comes into contact with the coupler rollers 36 of the shaft door that is still kept locked with the aid of the shaft door bolt 39; the entraining skid support 6, in the course of its further movement, cannot at first follow further in the direction of the arrow Z, but instead moves in relation to it in the direction opposite from the direction of the arrow Z. Since the second entraining skid 8*a* rests—preferably with its side oriented away from the coupler rollers 36—against the contact element 27, which is composed of the roller 28 and the axle 29 that is affixed to the slider 30, it transmits its relative movement to the slider 30. The slider 30 thus likewise moves relative to the entraining skid support 6 in the direction opposite from the direction of the arrow Z. As is best visible in FIG. 12, the slider thus pivots the reversing mechanism or rocker 32, which consequently pulls the control rod 33, whose other end is connected to the car door bolt 34. As a result, the control rod 33 pulls the car door bolt 34 out of its latch 35, thus unlocking the car door. At the same time, in a partially overlapping fashion, or subsequent to this, the second entraining skid 8*a* exerts a compressive force on its associated coupler roller 36 of the shaft door so that the shaft door bolt is unlocked, thus producing the position that is shown in FIG. 10.

With regard to the position shown in FIG. 10, it is noteworthy that the entraining skid support 6 then comes to a stop against the carriage 2 so that the securing coupling 17 is then closed and from this point on, the entraining skid support 6 and the carriage 2 move in tandem.

With regard to the position shown in FIG. 10, it is also noteworthy that the one of the entraining skids, namely the entraining skid 7, at this moment in which the car door and the shaft door have been unlocked, is preferably still partially lifted and therefore is not yet (or not yet completely) resting against the coupler rollers 36 of the shaft door. In particular, FIG. 10 clearly shows that the contact element or the roller 25 of the entraining skid 7 is still interacting with the actuating element, mostly in that it is still resting against the section of the actuating element 20 referred to as the "stopper" (in this regard, see FIG. 7).

As the carriage moves farther in the opening direction, the contact element or its roller 25 lowers relative to the actuating element 20 so that the first entraining skid reaches its closed position, as shown in FIG. 11. Now the first and second entraining skids 7, 8*a* securely hold the coupler rollers 36 of the shaft door between themselves and thus entrain the shaft door, as a rule without play or rattling. Here, too, it is once again noteworthy that the first entraining skid 7, together with its pivoting levers 9, is advantageously positioned on the entraining skid support in such a way that the pivoting levers are fully extended or at least essentially extended so that the reaction forces that are acting on the entraining skid 7 and tend to push it in the opening direction are not or are essentially not subjected to a torque that acts in the opening direction.

For the sake of completeness, it should be noted that the second entraining skid 8*a* also does not absolutely have to be guided on pivoting levers 9. Here, too, it is alternatively conceivable to support the mobile entraining skid 8*a* on the entraining skid support 6 in mobile fashion by virtue of the fact that the mobile entraining skid 8*a* has slots in which fixed bearing pins travel. Details about what such a slot-guided bearing can look like can be inferred from the previously published European patent application EP 2 287 104, which is once again incorporated in its entirety into the present description by reference.

It should also be noted that in this second exemplary embodiment as well, the actuating element 20 can likewise be embodied in a way that is entirely different from the example described above. It is thus easily possible for the actuating element 20 to be embodied as a control cable that is actuated by the carriage 2, for example at the moment in which it separates from the entraining skid support and begins to move relative to it. An actuating element that is embodied in this way basically corresponds to the one shown in FIG. 8, as an alternative design in conjunction with the first exemplary embodiment.

Figure 13:
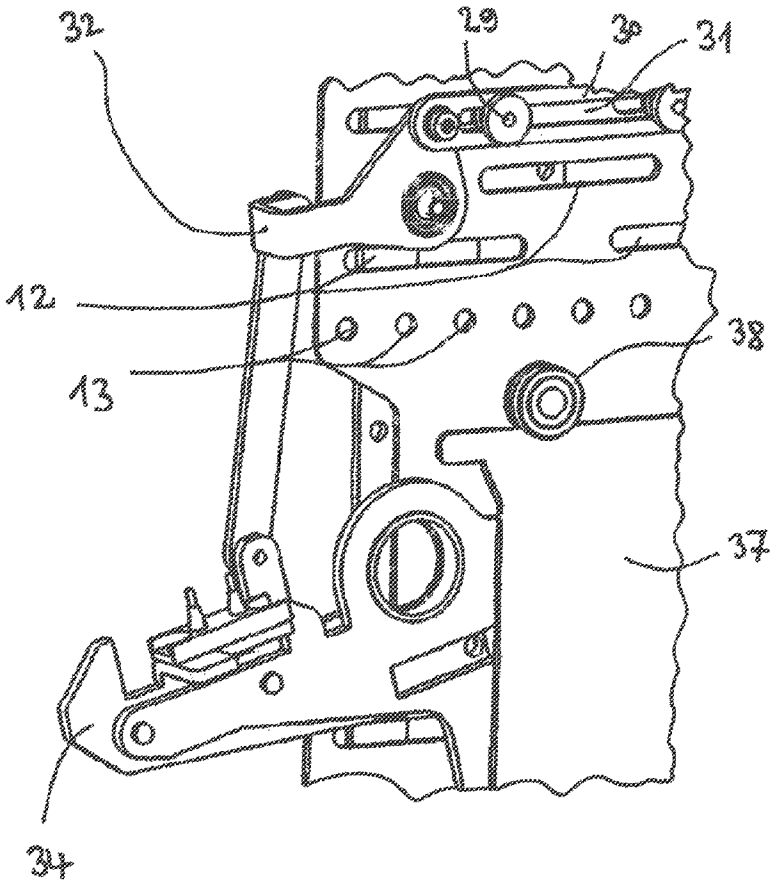
FIG. 13 shows a second version of the mechanism that is used for actuating the car door bolt in the second exemplary embodiment.

FIG. 13 shows an exemplary embodiment that largely corresponds to the exemplary embodiment described above in conjunction with FIGS. 9 through 12—with the difference that the car door bolt 34 does not drop into its latch 35 from above, as shown in FIG. 12, but is pulled into its latch from below. FIG. 13 clearly shows the slider 30, the lock support 37—which is supported on rollers 38 so that it is able to move in translatory fashion relative to the entraining skid support 6 and which is a component of the carriage, and the reversing mechanism 32—which is embodied here as a rocker. The figure also clearly shows the first and second openings 12, 13, which ensure the high degree of variability of the system, as well as the at least one oblong hole 31 provided for this same purpose in the slider 30 and the axle 29 of the actuating element 27 that is fastened in a suitable position therein.

Finally, it is advisable to provide a few general remarks for reasons relating to patent law. In general—as is universally applicable to the exemplary embodiments described above—protection is also claimed for the following reworded additional embodiments, both independently, paragraph by paragraph, without additional features, and in combination with one or more of the explicitly constructed claims and/or one or more features of the description or the claims:

A device for synchronously actuating and locking elevator doors, which are situated essentially one behind the other in the passage direction—such as a car door and a shaft door; the device includes entraining skids 7, 8 that are associated with a first driven door and whose spacing relative to one another can be changed in order to be able to couple the first door to the second door and move them together. In this case, at least one—and preferably only one—of the entraining skids 7 is supported in mobile fashion relative to the component, which holds it directly and is preferably embodied in the form of an entraining skid support 6, and toward the end of the closing movement, is secured so that it disengages from the second door, particularly by coming into contact with a stationary actuating element 20, which forces the at least one entraining skid 7 to execute a lifting movement.

Ideally, in order to disengage one or more of the entraining skids from the second door, a relative movement between the entraining skid support and the carriage 2 that is functionally associated with it is converted into a movement with a lifting/raising action or is used for this purpose.

In the above-mentioned spirit, protection is also claimed for a device that is distinguished by the fact that the at least one mobile entraining skid 7 is secured to an entraining skid support 6 in a mobile, preferably pivotable, fashion, with the entraining skid support 6 preferably being coupled directly to the linear drive unit.

In the above-mentioned spirit, protection is also claimed for a device that is distinguished by the fact that a carriage 2 of a door panel is connected to the entraining skid support 6 so that it is able to move relative to the latter, preferably in a translatory fashion, ideally so that when the carriage 2 of the door panel has come to a stop after the door is completely closed, the linear drive unit or its belt 4 can still move the entraining skid support 6 a certain distance further into its final closed position.

In the above-mentioned spirit, protection is also claimed for a device that is distinguished by the fact that a securing coupling 17 is provided, which limits the relative mobility between the entraining skid support 6 and the carriage 2 of the door panel for the duration of the travel of the carriage between its closed position and when it reaches its closed position again; the securing coupling 17 preferably includes a magnetic clamp.

In the above-mentioned spirit, protection is also claimed for a device that is distinguished by the fact that the actuating element 20 is immobilized relative to the guide rail 1 for the carriage 2.

In the above-mentioned spirit, protection is also claimed for a device that is distinguished by the fact that the actuating element 20 protrudes beyond an edge of the entraining skid support 6 on one side, preferably on the top side, and in this region, interacts directly with an entraining skid 7 and its contact element or roller 25.

In the above-mentioned spirit, protection is also claimed for a device that is distinguished by the fact that the actuating element 20 is at least partially embodied in the form of a wedge 24 that lifts the mobile entraining skid 7.

In the above-mentioned spirit, protection is also claimed for a device that is distinguished by the fact that the actuating element 20 is at least partially embodied in the form of a stopper 23, which prevents any further movement of the entraining skid 7 in the direction in which the entraining skid support 6 continues to move.

In the above-mentioned spirit, protection is also claimed for a device that is distinguished by the fact that the actuating element 20 has a preferably convex curved section or preferably a curved section that is composed of a wedge 24, a stopper 23, and a rounded section that joins the latter to each other, along which a contact element travels, preferably in the form of a roller 25 fastened to the entraining skid.

In the above-mentioned spirit, protection is also claimed for a device that is distinguished by the fact that the at least one mobile entraining skid 7 is secured on at least two pivoting levers 9, which are embodied and supported on the entraining skid 7 and the entraining skid support 6 so that when the entraining skids 7, 8 are completely coupled to the door that is to be entrained by them, each of the pivoting levers 9 has been oriented so that the forces that are exerted on the entraining skid both in the movement direction of the door and in the opposite direction can be at least essentially and preferably completely diverted by the pivoting levers 9, without the occurrence of a torque that acts on the pivoting levers 9.

In the above-mentioned spirit, protection is claimed for a device that is distinguished by the fact that the entraining skid that controls the opening and closing movement moves a slider 30 that is able to move in a completely or at least predominantly translatory fashion and that is in turn coupled to the car door bolt 34.

In the above-mentioned spirit, protection is also claimed for a device that is distinguished by the fact that the slider that is able to move in an essentially translatory fashion is supported on the side of the entraining skid support oriented away from the entraining skids.

In the above-mentioned spirit, protection is also claimed for a device that is distinguished by the fact that the slider is associated with a contact element 27, which is preferably comprised of a pin 29 that can be fastened to the slider 30 in different positions and preferably supports a roller 28, and the contact element 27 ideally protrudes through an opening 12 of the entraining skid support 6 into the region of the side of the entraining skid support 6 on which the entraining skids 7, 8*a* are situated.

In the above-mentioned spirit, protection is also claimed for a device that is distinguished by the fact that the entraining skid 8*a* that controls the opening and closing movement is not firmly coupled to the contact element 27, but is embodied so that only compressive forces can be transmitted between the entraining skid 8*a* and the contact element 27.

In the above-mentioned spirit, protection is also claimed for a device in which all of the pivoting levers that hold the entraining skids 7, 8, 8*a* are embodied as purely passive elements in such a way that they are not actively forced from the outside to execute a movement that they then in turn impart to the entraining skids 7, 8, 8*a*, but instead, the pivoting levers 9 merely react to forces that are imparted to them by the entraining skids 7, 8, 8*a*.

It is particularly important that a method for modernizing the door drive unit of existing elevator systems as such is also claimed. The claimed method is distinguished by the fact that first, an entraining skid support 6 is fastened to a carriage 2; previously or subsequently, entraining skids 7, 8 are fastened to the entraining skid support by means of alternatively provided openings 12 in a position in which they can properly couple to and uncouple from coupling sections of a door that is to be entrained; and preferably next, the position of an actuating element 20 relative to the entraining skid support 6 is set to the current position of at least one of the entraining skids 7 so that the actuating element lifts and closes the at least one entraining skid 7 as the entraining skid support 6 is being moved by the linear drive unit, in order to uncouple or couple it; preferably, oblong holes in an immobile entraining skid are used—after the positioning of a mobile entraining skid and the adjustment of preadjustment of its cooperation with an actuating element 20—to move the immobile entraining skid in the direction of its closed position and immobilize it there so that the entraining skids hold the coupling elements of the entrained door in its proper closed position at least essentially without play or with a predetermined play between them.

Last but not least, use protection is also claimed, particularly for the use of an entraining skid support 6, preferably in the form an essentially flat plate, which is provided with a plurality of alternatively used first and/or second and/or third openings 12, 13, 14, which are prefabricated, preferably punched, in series for the installation of the entraining skids 7, 8 in different functional positions, preferably for modernizing the door drive unit of differently embodied existing elevator systems.

Use protection—in and of itself or in combination with the use protection claimed above—is also claimed for the use of an obstacle, which can be affixed in a changeable position, ideally by means of one or more oblong holes and/or alternative fastening holes and/or a rail-like press fit, with which the at least one entraining skid comes into contact in order to thus be lifted, once again preferably for modernizing the door drive unit of differently embodied existing elevator systems.

The invention claimed is:

1. A device for synchronously actuating and locking elevator doors, which are situated essentially one behind the other in a passage direction—such as a car door and a shaft door; the device comprising:

a plurality of entraining skids that are fastened to a first door by an entraining skid support and whose spacing relative to one another can be changed in order to couple the first door to a second door and move the two doors together, and the device is coupled to a linear drive unit that moves the doors in opening and closing directions, wherein the entraining skid support has a plurality of first openings for mounting at least one of the entraining skids on the entraining skid support in different functional positions.

2. The device according to claim 1, wherein the first openings constitute a field or matrix for affixing at least one of the entraining skids to the entraining skid support in different functional positions in both a vertical and a horizontal direction.

3. The device according to claim 2, wherein at least two of the first openings are oblong holes whose length exceeds the maximum width of at least one of the entraining skids transverse to a movement direction of a carriage.

4. The device according to claim 1, wherein at least two of the first openings are oblong holes.

5. The device according to claim 1, wherein the entraining skid support has a plurality of second openings for connecting the entraining skid support to a mobile element of the linear drive unit in a different way.

6. The device according to claim 5, wherein the entraining skid support has a plurality of third openings for fastening a carriage of a door panel to the entraining skid support in different positions, in such a way that the entraining skid support is secured to the carriage so that the entraining skid support is able to move relative to the carriage by a particular amount.

7. The device according to claim 1, wherein one entraining skid is affixed to the entraining skid support in a functional position in which the entraining skid is immobilized relative to the entraining skid support.

8. The device according to claim 7, wherein the immobilized entraining skid has at least four oblong holes, which are positioned and matched to the openings in the entraining skid support so that by using these holes, the entraining skid can be fastened in different positions relative to the entraining skid support; and the holes simultaneously serve to fasten a door contact switch or a part of it to the entraining skid in different positions.

9. The device according to claim 8, wherein a pattern spacing of the openings of the entraining skid support that are alternatively used for the fastening and a pattern spacing of the holes in the entraining skid(s) that are alternatively available for the fastening match each other.

10. The device according to claim 8, wherein a pattern spacing of the openings of the entraining skid support that are alternatively used for the fastening and a pattern spacing of the holes in the entraining skid(s) that are alternatively available for the fastening at least partially do not match each other.

11. The device according to claim 1, wherein only one entraining skid is mounted on the entraining skid support in a functional position in which the entraining skid is mobile relative to the entraining skid support.

12. The device according to claim 11, wherein the entraining skid is mounted on the entraining skid support with at least two pivoting levers; each of the pivoting levers has a first mobile bearing with a first axle that connects it to the entraining skid and a second mobile bearing with a second axle that connects it to the entraining skid support; and the second axles can be affixed to the entraining skid support in different functional positions using first openings in the entraining skid support.

13. The device according to claim 11, wherein the mobile entraining skid has at least four holes, which are positioned and matched to the openings in the entraining skid support so that by using these holes, the entraining skid can be affixed in different positions relative to the entraining skid support; and the holes simultaneously serve to permit an entraining skid or an entraining roller to be fastened in different positions in order to interact with an actuating element.

14. The device according to claim 1, wherein one of the entraining skids simultaneously serves as a contact support for at least a part of a contact that indicates that the door is situated in its completely closed position.

15. The device according to claim 1, further comprising an actuating element that couples and uncouples the entraining skids to and from the door that is to be entrained and in so doing, interacts with at least one entraining skid so that the actuating element does not place any absolute requirements on the positioning of the entraining skids on the entraining skid support and instead permits utilization of all mounting positions that are made possible by different openings of the entraining skid support that are available to be used alternatively.

16. The device according to claim 15, wherein an entraining skid that does not interact directly with the actuating element directly controls the opening and closing movement of a car door bolt.

17. The device according to claim 16, wherein the entraining skid that controls the opening and closing movement moves a slider that is able to move in a completely or at least predominantly translatory fashion and that is in turn coupled to the car door bolt.

18. The device according to claim 17, wherein the slider that is able to move in an essentially translatory fashion is supported on a side of the entraining skid support oriented away from the entraining skids.

19. The device according to claim 17, wherein the slider is associated with a contact element that is composed of a pin, which can be fastened in different positions on the slider and supports a roller, and the contact element protrudes through an opening of the entraining skid support into a region on a side of the entraining skid support on which the entraining skids are located.

20. The device according to claim 19, wherein the entraining skid that controls the opening and closing movement is not firmly coupled to the contact element, but is embodied so that only compressive forces can be transmitted between the entraining skid and the contact element.

21. The device according to claim 17, wherein the slider has a plurality of holes that are suitable for fastening the pin in different positions and are arranged one after another, in a row, and/or in at least one oblong hole.

22. The device according to claim 21, wherein the slider has a plurality of rows of holes that are situated next to one another in relation to its sliding direction and/or a plurality of oblong holes that are at least partially situated next to one another in relation to its sliding direction.

23. An elevator apparatus, comprising:

a guide rail mounted to a car and at least one carriage mounted to the car, with a car door panel that is fastened thereto as well as a guide rail on the floor of the car for additional guidance of the at least one car door panel, and a device according to claim 1.

* * * * *